US009672763B2

(12) United States Patent
Guo et al.

(10) Patent No.: US 9,672,763 B2
(45) Date of Patent: Jun. 6, 2017

(54) PIXEL ARRAY AND DRIVING METHOD THEREOF, DISPLAY PANEL AND DISPLAY DEVICE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Renwei Guo, Beijing (CN); Xue Dong, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 221 days.

(21) Appl. No.: 14/421,906

(22) PCT Filed: Jun. 30, 2014

(86) PCT No.: PCT/CN2014/081123

§ 371 (c)(1),
(2) Date: Feb. 16, 2015

(87) PCT Pub. No.: WO2015/100986

PCT Pub. Date: Jul. 9, 2015

(65) Prior Publication Data

US 2016/0027358 A1 Jan. 28, 2016

(30) Foreign Application Priority Data

Dec. 30, 2013 (CN) ..... 2013 1 0744880

(51) Int. Cl.
*G09G 3/20* (2006.01)

(52) U.S. Cl.
CPC ..... *G09G 3/2003* (2013.01); *G09G 3/20* (2013.01); *G09G 2300/0452* (2013.01); *G09G 2310/08* (2013.01); *G09G 2320/0242* (2013.01)

(58) Field of Classification Search
CPC ..... G09G 3/2003; G09G 2320/0242; G09G 2310/08
See application file for complete search history.

(56) References Cited

U.S. PATENT DOCUMENTS

2004/0246381 A1 12/2004 Credelle
2008/0225027 A1 9/2008 Toyomura et al.
2009/0073099 A1* 3/2009 Yeates et al. ..... G02F 1/1362 345/88

FOREIGN PATENT DOCUMENTS

CH CN102243828 * 7/2011
CN 1551383 A 12/2004
(Continued)

OTHER PUBLICATIONS

Notification of the Second Office Action dated Sep. 22, 2015 corresponding to Chinese application No. 201310744880.9.
(Continued)

*Primary Examiner* — Shaheda Abdin
(74) *Attorney, Agent, or Firm* — Nath, Goldberg & Meyer; Joshua B. Goldberg

(57) ABSTRACT

The present invention provides a pixel array including multiple pixel units, each of which includes two rows of sub-pixels, and each row of sub-pixels includes four sub-pixels of different colors, wherein in each pixel unit, colors of the first two sub-pixels in the previous row are the same as those of the last two sub-pixels in the next row, colors of the last two sub-pixels in the previous row are the same as those of the first two sub-pixels in the next row, and in the same row, any two adjacent sub-pixels form one pixel block.
(Continued)

The present invention further provides a driving method of the above-mentioned pixel array, a display panel including the pixel array and a display device including the display panel.

18 Claims, 6 Drawing Sheets

(56) References Cited

FOREIGN PATENT DOCUMENTS

| | | | | |
|---|---|---|---|---|
| CN | 101312015 | A | | 11/2008 |
| CN | 102243827 | A | | 11/2011 |
| CN | 102243828 | A | | 11/2011 |
| CN | 202189508 | U | | 4/2012 |
| CN | 202363037 | U | | 8/2012 |
| CN | 202904169 | U | | 4/2013 |
| CN | 103093722 | A | | 5/2013 |
| CN | 103559849 | A | | 2/2014 |
| CN | 103714751 | A | | 4/2014 |
| JP | 2002369212 | A | | 12/2002 |
| JP | 2007532949 | A | | 11/2007 |
| JP | 2009069833 | A | * | 4/2009 |

OTHER PUBLICATIONS

Search Report issued in International Application No. PCT/CN2014/081123, dated Jun. 30, 2014 (Jun. 30, 2014).

Chinese Patent Application No. 201310744880.9, Office Action dated Apr. 29, 2015, ten (10) pages. English translation attached twelve (12) pages.

International Application No. PCT/CN2014/081123, Written Opinion of the International Searching Authority dated Sep. 1, 2014, eight (8) pages, English Translation.

* cited by examiner

| | S4 | S8 | S12 | S2 | S6 | S10 | S1 | S5 | S9 | S3 | S7 | S11 |
|---|---|---|---|---|---|---|---|---|---|---|---|---|
| (a) | {3/4 [0.1; | 0.8; | 0.1;]} | {3/4 [0.1; | 0.8; | 0.1;]} | {3/4 [0.1; | 0.8; | 0.1;]} | {1/4 [0.1; | 0.8; | 0.1;]} |
| (b) | {3/4 [0.15; | 0.7; | 0.15;]} | {3/4 [0.15; | 0.7; | 0.15;]} | {3/4 [0.15; | 0.7; | 0.15;]} | {1/4 [0.15; | 0.7; | 0.15;]} |
| (c) | {3/4 [0.2; | 0.6; | 0.2;]} | {3/4 [0.2; | 0.6; | 0.2;]} | {3/4 [0.2; | 0.6; | 0.2;]} | {1/4 [0.2; | 0.6; | 0.2;]} |
| (d) | {3/4 [0.25; | 0.5; | 0.25;]} | {3/4 [0.25; | 0.5; | 0.25;]} | {3/4 [0.25; | 0.5; | 0.25;]} | {1/4 [0.25; | 0.5; | 0.25;]} |
| (e) | {3/4 [0.1; | 0.8; | 0.1;]} | {3/4 [0.15; | 0.7; | 0.15;]} | {3/4 [0.1; | 0.8; | 0.1;]} | {1/4 [0.1; | 0.8; | 0.1;]} |
| (f) | {3/4 [0.15; | 0.7; | 0.15;]} | {3/4 [0.1; | 0.8; | 0.1;]} | {3/4 [0.15; | 0.7; | 0.15;]} | {1/4 [0.15; | 0.7; | 0.15;]} |
| (g) | {3/4 [0.2; | 0.6; | 0.2;]} | {3/4 [0.2; | 0.6; | 0.2;]} | {3/4 [0.25; | 0.5; | 0.25;]} | {1/4 [0.25; | 0.5; | 0.25;]} |
| (h) | {3/4 [0.25; | 0.5; | 0.25;]} | {3/4 [0.25; | 0.5; | 0.25;]} | {3/4 [0.2; | 0.6; | 0.2;]} | {1/4 [0.2; | 0.6; | 0.2;]} |

| | S4 | S8 | S12 | S2 | S6 | S10 | S1 | S5 | S9 | S3 | S7 | S11 |
|---|---|---|---|---|---|---|---|---|---|---|---|---|
| (a) | {4/5 [0.1; | 0.8; | 0.1;]} | {4/5 [0.1; | 0.8; | 0.1;]} | {4/5 [0.1; | 0.8; | 0.1;]} | {1/5 [0.1; | 0.8; | 0.1;]} |
| (b) | {4/5 [0.15; | 0.7; | 0.15;]} | {4/5 [0.15; | 0.7; | 0.15;]} | {4/5 [0.15; | 0.7; | 0.15;]} | {1/5 [0.15; | 0.7; | 0.15;]} |
| (c) | {4/5 [0.2; | 0.6; | 0.2;]} | {4/5 [0.2; | 0.6; | 0.2;]} | {4/5 [0.2; | 0.6; | 0.2;]} | {1/5 [0.2; | 0.6; | 0.2;]} |
| (d) | {4/5 [0.25; | 0.5; | 0.25;]} | {4/5 [0.25; | 0.5; | 0.25;]} | {4/5 [0.25; | 0.5; | 0.25;]} | {1/5 [0.25; | 0.5; | 0.25;]} |
| (e) | {4/5 [0.1; | 0.8; | 0.1;]} | {4/5 [0.15; | 0.7; | 0.15;]} | {4/5 [0.1; | 0.8; | 0.1;]} | {1/5 [0.1; | 0.8; | 0.1;]} |
| (f) | {4/5 [0.15; | 0.7; | 0.15;]} | {4/5 [0.1; | 0.8; | 0.1;]} | {4/5 [0.15; | 0.7; | 0.15;]} | {1/5 [0.15; | 0.7; | 0.15;]} |
| (g) | {4/5 [0.2; | 0.6; | 0.2;]} | {4/5 [0.2; | 0.6; | 0.2;]} | {4/5 [0.25; | 0.5; | 0.25;]} | {1/5 [0.25; | 0.5; | 0.25;]} |
| (h) | {4/5 [0.25; | 0.5; | 0.25;]} | {4/5 [0.25; | 0.5; | 0.25;]} | {4/5 [0.2; | 0.6; | 0.2;]} | {1/5 [0.2; | 0.6; | 0.2;]} |

| | S4 S8 S12 S16 S20 | S2 S6 S10 S14 S18 | S1 S5 S9 S13 S17 | S3 S7 S11 S15 S19 |
|---|---|---|---|---|
| (a) | {3/4[0.02; 0.08; 0.8; 0.08; 0.02;]} | {3/4[0.02; 0.08; 0.8; 0.08; 0.02;]} | {3/4[0.02; 0.08; 0.8; 0.08; 0.02;]} | {1/4[0.02; 0.08; 0.8; 0.08; 0.02;]} |
| (b) | {3/4[0.05; 0.1; 0.7; 0.1; 0.05;]} | {3/4[0.05; 0.1; 0.7; 0.1; 0.05;]} | {3/4[0.05; 0.1; 0.7; 0.1; 0.05;]} | {1/4[0.05; 0.1; 0.7; 0.1; 0.05;]} |
| (c) | {3/4[0.05; 0.15; 0.6; 0.15; 0.05;]} | {3/4[0.05; 0.15; 0.6; 0.15; 0.05;]} | {3/4[0.05; 0.15; 0.6; 0.15; 0.05;]} | {1/4[0.05; 0.15; 0.6; 0.15; 0.05;]} |
| (d) | {3/4[0.05; 0.2; 0.5; 0.2; 0.05;]} | {3/4[0.05; 0.2; 0.5; 0.2; 0.05;]} | {3/4[0.05; 0.2; 0.5; 0.2; 0.05;]} | {1/4[0.05; 0.2; 0.5; 0.2; 0.05;]} |
| (e) | {3/4[0.02; 0.08; 0.8; 0.08; 0.02;]} | {3/4[0.05; 0.1; 0.7; 0.1; 0.05;]} | {3/4[0.02; 0.08; 0.8; 0.08; 0.02;]} | {1/4[0.02; 0.08; 0.8; 0.08; 0.02;]} |
| (f) | {3/4[0.05; 0.1; 0.7; 0.1; 0.05;]} | {3/4[0.02; 0.08; 0.8; 0.08; 0.02;]} | {3/4[0.05; 0.1; 0.7; 0.1; 0.05;]} | {1/4[0.05; 0.1; 0.7; 0.1; 0.05;]} |
| (g) | {3/4[0.05; 0.15; 0.6; 0.15; 0.05;]} | {3/4[0.05; 0.15; 0.6; 0.15; 0.05;]} | {3/4[0.05; 0.2; 0.5; 0.2; 0.05;]} | {1/4[0.05; 0.2; 0.5; 0.2; 0.05;]} |
| (h) | {3/4[0.05; 0.2; 0.5; 0.2; 0.05;]} | {3/4[0.05; 0.2; 0.5; 0.2; 0.05;]} | {3/4[0.05; 0.15; 0.6; 0.15; 0.05;]} | {1/4[0.05; 0.15; 0.6; 0.15; 0.05;]} |

Fig.13

PIXEL ARRAY AND DRIVING METHOD THEREOF, DISPLAY PANEL AND DISPLAY DEVICE

This is a National Phase Application filed under 35 U.S.C. 371 as a national stage of PCT/CN2014/081123, filed Jun. 30, 2014, an application claiming the benefit to Chinese application No. 201310744880.9, filed on Dec. 30, 2013; the content of each of which is hereby incorporated by reference in its entirety.

FIELD OF THE INVENTION

The present invention relates to the field of display technology, and particularly relates to a pixel array, a driving method of the pixel array, a display panel including the pixel array and a display device including the display panel.

BACKGROUND OF THE INVENTION

In an existing display panel, as a common pixel design, three sub-pixels (including a red sub-pixel, a green sub-pixel and a blue sub-pixel) or four sub-pixels (a red sub-pixel, a green sub-pixel, a blue sub-pixel and a white sub-pixel) form a pixel unit for display.

If pixel per inch (PPI) of a display panel is low, a user will obviously feel that the display is grainy (i.e., edge of a displayed image is unsmooth and is serrated) when watching a display screen. With the increased requirements of the user on the watching experience of the display screen, the PPI of the display panel needs to be increased. However, the increased PPI of the display panel will increase difficulty in the manufacturing process of the display panel.

Under the condition that the difficulty in the manufacturing process is not increased (i.e., the PPI is not increased), how to make the display panel less grainy, so as to achieve display effect of a display panel with a higher resolution under the same size becomes a technical problem to be urgently solved in the field.

SUMMARY OF THE INVENTION

The purpose of the present invention is to provide a pixel array, a driving method of the pixel array, a display panel including the pixel array and a display device including the display panel. By using the driving method to drive the pixel array, the display panel can be less grainy, so as to achieve display effect of a display panel with a higher resolution under the same size.

As one aspect of the present invention, there is provided a pixel array, including a plurality of pixel units, each of which includes two rows of sub-pixels, and each row of sub-pixels includes four sub-pixels of different colors, wherein, in each pixel unit, colors of the first two sub-pixels in the previous row are the same as those of the last two sub-pixels in the next row, colors of the last two sub-pixels in the previous row are the same as those of the first two sub-pixels in the next row, and in the same row, any two adjacent sub-pixels form one pixel block.

Preferably, in each pixel unit, a sequence in which the first two sub-pixels in the previous row are arranged is the same as a sequence in which the last two sub-pixels in the next row are arranged.

Preferably, in each pixel unit:

the first two sub-pixels in the previous row are sequentially a blue sub-pixel and a green sub-pixel, and the last two sub-pixels in the next row are sequentially a blue sub-pixel and a green sub-pixel; or the first two sub-pixels in the previous row are sequentially a blue sub-pixel and a red sub-pixel, and the last two sub-pixels in the next row are sequentially a blue sub-pixel and a red sub-pixel; or the first two sub-pixels in the previous row are sequentially a red sub-pixel and a blue sub-pixel, and the last two sub-pixels in the next row are sequentially a red sub-pixel and a blue sub-pixel; or the first two sub-pixels in the previous row are sequentially a green sub-pixel and a red sub-pixel, and the last two sub-pixels in the next row are sequentially a green sub-pixel and a red sub-pixel; or the first two sub-pixels in the previous row are sequentially a red sub-pixel and a green sub-pixel, and the last two sub-pixels in the next row are sequentially a red sub-pixel and a green sub-pixel; or the first two sub-pixels in the previous row are sequentially a green sub-pixel and a blue sub-pixel, and the last two sub-pixels in the next row are sequentially a green sub-pixel and a blue sub-pixel.

Preferably, in each pixel unit, a sequence in which the first two sub-pixels in the previous row are arranged is opposite to a sequence in which the last two sub-pixels in the next row are arranged.

Preferably, in each pixel unit:

the first two sub-pixels in the previous row are sequentially a blue sub-pixel and a red sub-pixel, and the last two sub-pixels in the next row are sequentially a red sub-pixel and a blue sub-pixel; or the first two sub-pixels in the previous row are sequentially a blue sub-pixel and a green sub-pixel, and the last two sub-pixels in the next row are sequentially a green sub-pixel and a blue sub-pixel; or the first two sub-pixels in the previous row are sequentially a red sub-pixel and a blue sub-pixel, and the last two sub-pixels in the next row are sequentially a blue sub-pixel and a red sub-pixel; or the first two sub-pixels in the previous row are sequentially a green sub-pixel and a red sub-pixel, and the last two sub-pixels in the next row are sequentially a red sub-pixel and a green sub-pixel; or the first two sub-pixels in the previous row are sequentially a red sub-pixel and a green sub-pixel, and the last two sub-pixels in the next row are sequentially a green sub-pixel and a red sub-pixel; or the first two sub-pixels in the previous row are sequentially a green sub-pixel and a blue sub-pixel, and the last two sub-pixels in the next row are sequentially a blue sub-pixel and a green sub-pixel.

Preferably, in each pixel unit, a sequence in which the last two sub-pixels in the previous row are arranged is the same as a sequence in which the first two sub-pixels in the next row are arranged.

Preferably, in each pixel unit, a sequence in which the last two sub-pixels in the previous row are arranged is opposite to a sequence in which the first two sub-pixels in the next row are arranged.

As another aspect of the present invention, there is provided a driving method of a pixel array, wherein the pixel array is the above-mentioned pixel array provided by the present invention, and the driving method includes steps of:

S1. calculating a theoretical brightness value of an image to be displayed at each sub-pixel;

S2. calculating an actual brightness value of each sub-pixel, wherein the actual brightness value of each sub-pixel is the sum of a portion of the theoretical brightness value of the sub-pixel and a portion or portions of the theoretical brightness value of one or more sub-pixels having the same color as the sub-pixel in the same row; and S3. inputting a signal to each sub-pixel, so as to enable each sub-pixel to achieve the actual brightness value calculated in the step of S2.

Preferably, the pixel array includes Y columns of sub-pixels, A (m, n) refers to the actual brightness value of the sub-pixel in the $m^{th}$ row and $n^{th}$ column, T (m, n) refers to the theoretical brightness value of the sub-pixel in the $m^{th}$ row and $n^{th}$ column, T (m, n−4) refers to the theoretical brightness value of the sub-pixel in the $m^{th}$ row and $(n-4)^{th}$ column, T (m, n+4) refers to the theoretical brightness value of the sub-pixel in the $m^{th}$ row and $(n+4)^{th}$ column, in the step of S2, calculating the actual brightness value of each sub-pixel by using a formula $A(m,n)=x[aT(m,n-4)+bT(m,n)+aT(m,n+4)]$, wherein m is a natural number, n is a natural number, $5 \le n \le Y-4$, $2a+b=1$, and $0<x<1$;

or, calculating the actual brightness value of each sub-pixel by using a formula $A(m,n)=x[cT(m,n)+dT(m,n+4)]$, wherein m is a natural number, n is a natural number smaller than 5, $c+d=1$, and $0<x<1$;

or, calculating the actual brightness value of each sub-pixel by using a formula $A(m,n)=x[ET(m,n-4)+FT(m,n)]$, wherein m is a natural number, n is a natural number, $n>Y-4$, $E+F=1$, and $0<x<1$.

Preferably, the pixel array includes Y columns of sub-pixels, A (m, n) refers to the actual brightness value of the sub-pixel in the $m^{th}$ row and $n^{th}$ column, T (m, n) refers to the theoretical brightness value of the sub-pixel in the $m^{th}$ row and $n^{th}$ column, T (m, n−8) refers to the theoretical brightness value of the sub-pixel in the $m^{th}$ row and $(n-8)^{th}$ column, T (m, n−4) refers to the theoretical brightness value of the sub-pixel in the $m^{th}$ row and $(n-4)^{th}$ column, T (m, n+4) refers to the theoretical brightness value of the sub-pixel in the $m^{th}$ row and $(n+4)^{th}$ column, T (m, n+8) refers to the theoretical brightness value of the sub-pixel in the $m^{th}$ row and $(n+8)^{th}$ column, in the step of S2, calculating the actual brightness value of each sub-pixel by using a formula $A(m,n)=x[eT(m,n-8)+fT(m,n-4)+gT(m,n)+fT(m,n+4)+eT(m,n+8)]$, wherein m is a natural number, n is a natural number, $9 \le n \le Y-8$, $2e+2f+g=1$, and $0<x<1$;

or, calculating the actual brightness value of each sub-pixel by using a formula $A(m,n)=x[hT(m,n)+iT(m,n+4)+jT(m,n+8)]$, wherein m is a natural number, n is a natural number not larger than 4, $h+i+j=1$, and $0<x<1$;

or, calculating the actual brightness value of each sub-pixel by using a formula $A(m,n)=x[lT(m,n-4)+kT(m,n)+lT(m,n+4)+MT(m,n+8)]$, wherein m is a natural number, n is a natural number, $4<n \le 8$, $2l+M+k=1$, and $0<x<1$;

or, calculating the actual brightness value of each sub-pixel by using a formula $A(m,n)=x[MT(m,n-8)+NT(m,n-4)+oT(m,n)+NT(m,n+4)]$, wherein m is a natural number, n is a natural number, $Y-8<n \le Y-4$, $M+2N+o=1$, and $0<x<1$;

or, calculating the actual brightness value of each sub-pixel by using a formula $A(m,n)=x[pT(m,n-8)+qT(m,n-4)+rT(m,n)]$, wherein m is a natural number, n is a natural number, $Y-4<n \le Y$, $p+q+r=1$, and $0<x<1$.

Preferably, the four sub-pixels of different colors include a red sub-pixel, a green sub-pixel, a blue sub-pixel and an X sub-pixel, the X sub-pixel is a white sub-pixel, when the sub-pixel in the $m^{th}$ row and $n^{th}$ column is not a white sub-pixel, x is x1, and when the sub-pixel in the $m^{th}$ row and $n^{th}$ column is a white sub-pixel, x is x2, wherein $x2 \le 0.25$, and $x1+x2=1$.

Preferably, x1 is ¾ or ⅘.

As another aspect of the present invention, there is provided a display panel, including a pixel array, wherein the pixel array is the above-mentioned pixel array provided by the present invention.

As still another aspect of the present invention, there is provided a display device, including the above-mentioned display panel provided by the present invention.

In the prior art, generally, three sub-pixels in the same row form a pixel block to serve as a physical pixel unit, however in the present invention, two adjacent sub-pixels in the same row may form a pixel block with the same size, namely, the pixel block occupies the same area as the pixel block formed by the three sub-pixels in the prior art. Therefore, compared with the prior art, in the present invention, the widths of the sub-pixels are increased, difficulty in the manufacturing process of the pixel array is reduced, and the yield of the product is improved. Moreover, by using the driving method provided by the present invention to drive the pixel array, the display panel can be less grainy, thus achieving display effect of a display panel with a higher resolution under the same size.

BRIEF DESCRIPTION OF THE DRAWINGS

Accompanying drawings, constituting a part of the description, are used for providing further understanding of the present invention and explaining the present invention together with the following specific embodiments, rather than limiting the present invention. In the accompanying drawings:

FIG. 13 is an algorithm matrix of the second embodiment of a driving method provided by the present invention, when the X sub-pixel is a white sub-pixel.

REFERENCE SYMBOLS

R: red sub-pixel

G: green sub-pixel

B: blue sub-pixel
W: white sub-pixel

DETAILED DESCRIPTION OF THE EMBODIMENTS

A detailed description of the specific embodiments of the present invention will be given below in combination with the accompanying drawings. It should be understood that, the specific embodiments described herein are merely used for illustrating and explaining the present invention, rather than limiting the present invention.

Figure 1:
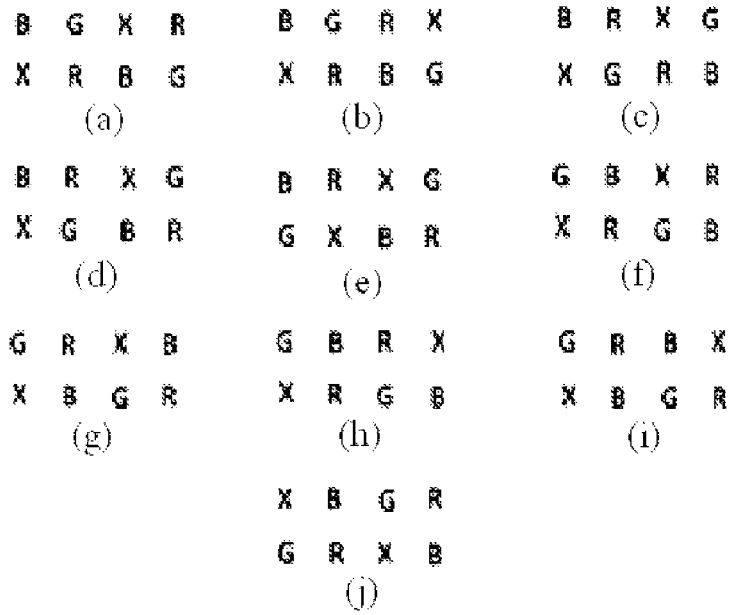
FIG. 1 is a schematic diagram of a pixel array provided by the present invention.
Figure 2:
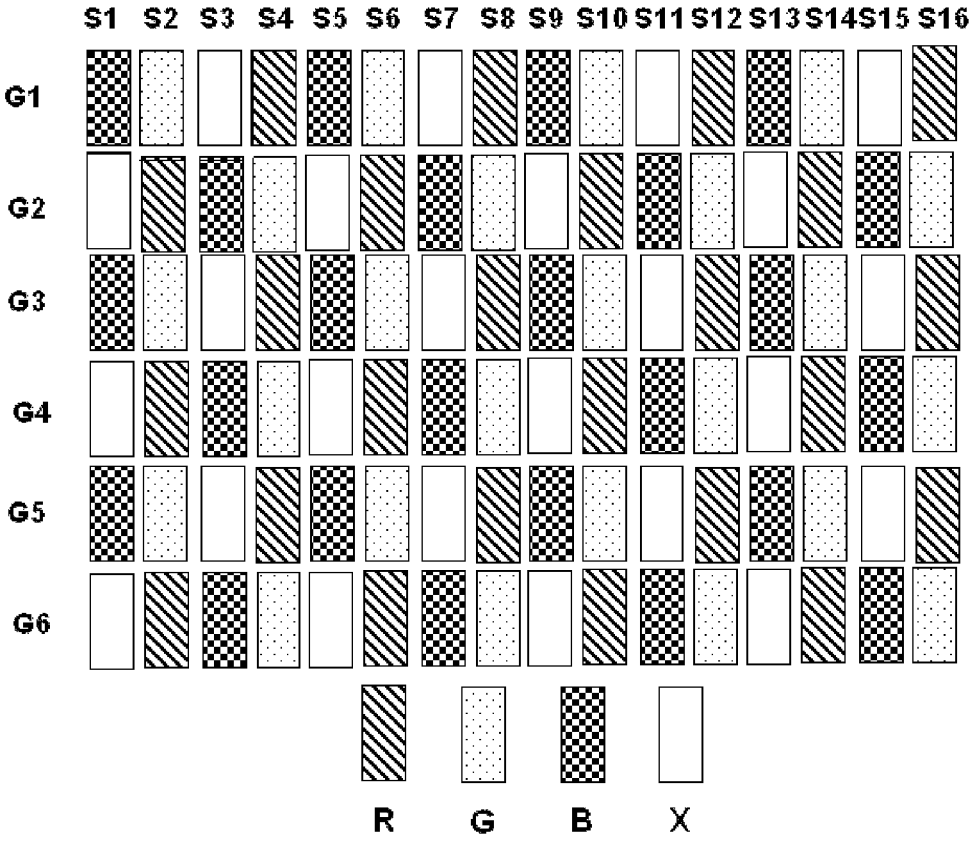
FIG. 2 is a schematic diagram of a pixel array shown in FIG. 1(*a*)

As shown in FIG. 1 and FIG. 2, as one aspect of the present invention, there is provided a pixel array including a plurality of pixel units, each of which includes two rows of sub-pixels, and each row of sub-pixels includes four sub-pixels of different colors, wherein, in each pixel unit, colors of the first two sub-pixels in the previous row are the same as those of the last two sub-pixels in the next row, colors of the last two sub-pixels in the previous row are the same as those of the first two sub-pixels in the next row, and in the same row, any two adjacent sub-pixels form one pixel block.

In general, the four sub-pixels of different colors may be respectively a red sub-pixel R, a green sub-pixel G, a blue sub-pixel B and an X sub-pixel. In the present invention, the color of the X sub-pixel is not particularly limited, as long as it is of a color other than red, green and blue, for example, the X sub-pixel may be a white sub-pixel, or may also be a yellow sub-pixel, a cyan sub-pixel or the like.

In the prior art, generally, three sub-pixels sequentially arranged in the same row form a pixel block to serve as a physical pixel unit, namely, if the sizes of the sub-pixels are the same, the width of each sub-pixel is about ⅓ of the width of the physical pixel unit. In the present invention, two adjacent sub-pixels in the same row can form a pixel block, of which an area is equal to that of the pixel block formed by three sub-pixels in the prior art. Therefore, compared with the prior art, the widths of the sub-pixels in the present invention are increased, difficulty in the manufacturing process of the pixel array is reduced, and the yield of the product is improved.

It can be considered that, the length and width of the pixel block formed by the two adjacent sub-pixels in the same row are approximately equal to each other, or the ratio of the width of the pixel block to the length of the sub-pixel is between 0.8 and 1.2, namely, the shape of the pixel block is a square or an approximate square, and of course, the pixel block may also have other shape or width-length ratio.

For each sub-pixel, the width of the sub-pixel may be ½ of the length of the sub-pixel. Of course, the structure of each sub-pixel is not strictly limited to that the width of the sub-pixel is ½ of the length of the sub-pixel, for example, for each sub-pixel, the width of the sub-pixel may be ⅖ to ⅗ of the length of the sub-pixel, and thus it is ensured that the two adjacent sub-pixels can form the above-mentioned pixel block.

That is, when the pixel array is used in an array substrate, gate lines and data lines intersect with each other to divide the array substrate into a plurality of pixel units. The distance of each sub-pixel along the gate line direction may be ½ of that of the sub-pixel along the data line direction.

The pixel array is formed by arranging the plurality of pixel units, and since in each pixel unit, the colors of the first two sub-pixels in the previous row are the same as those of the last two sub-pixels in the next row, and the colors of the last two sub-pixels in the previous row are the same as those of the first two sub-pixels in the next row, it is ensured that the sub-pixels of four colors exist in a diagonal direction of the pixel array, thus preventing the occurrence of a colored edge in the diagonal direction of the display panel when the pixel array is applied to the display panel.

It should be understood that, the "colors of the first two sub-pixels in the previous row are the same as those of the last two sub-pixels in the next row" refers to that the colors included in the first two sub-pixels in the previous row are the same as those included in the last two sub-pixels in the next row, but the sequences in which the colors are arranged are not necessarily the same. For example, the first two sub-pixels in the previous row may be a red sub-pixel R and a green sub-pixel G which are sequentially arranged, and the last two sub-pixels in the next row may be a red sub-pixel R and a green sub-pixel G which are sequentially arranged, or may also be a green sub-pixel G and a red sub-pixel R which are sequentially arranged, the arrangement of other colors is similar, and will not be repeated redundantly.

According to the pixel array provided by the present invention, a smaller number of sub-pixels can be used to achieve display effect of a display panel with a higher resolution under the same size. How to achieve this technical effect will be specifically described below.

In the present invention, the specific sequence in which the sub-pixels in the pixel units are arranged is not particularly regulated, as long as it can be ensured that, in each pixel unit, the colors of the first two sub-pixels in the previous row are the same as those of the last two sub-pixels in the next row, and the colors of the last two sub-pixels in the previous row are the same as those of the first two sub-pixels in the next row. For example, as an embodiment of the present invention, in each pixel unit, the sequence in which the first two sub-pixels in the previous row are arranged is the same as the sequence in which the last two sub-pixels in the next row are arranged.

Specifically, as shown in FIG. 1(*a*) and FIG. 1(*b*), in each pixel unit, the first two sub-pixels in the previous row are sequentially a blue sub-pixel B and a green sub-pixel G, and the last two sub-pixels in the next row are sequentially a blue sub-pixel B and a green sub-pixel G; or as shown in FIG. 1(*d*) and FIG. 1(*e*), the first two sub-pixels in the previous row are sequentially a blue sub-pixel B and a red sub-pixel R, and the last two sub-pixels in the next row are sequentially a blue sub-pixel B and a red sub-pixel R; or as shown in FIG. 1(*g*) and FIG. 1(*i*), the first two sub-pixels in the previous row are sequentially a green sub-pixel G and a red sub-pixel R, and the last two sub-pixels in the next row are sequentially a green sub-pixel G and a red sub-pixel R; or as shown in FIG. 1(*f*) and FIG. 1(*h*), the first two sub-pixels in the previous row are sequentially a green sub-pixel G and a blue sub-pixel B, and the last two sub-pixels in the next row are sequentially a green sub-pixel G and a blue sub-pixel B.

Of course, in the pixel array provided by this embodiment, the first two sub-pixels in the previous row are sequentially a red sub-pixel and a blue sub-pixel, and the last two sub-pixels in the next row are sequentially a red sub-pixel and a blue sub-pixel; or the first two sub-pixels in the previous row are sequentially a red sub-pixel and a green sub-pixel, and the last two sub-pixels in the next row are sequentially a red sub-pixel and a green sub-pixel.

Alternatively, as another embodiment of the present invention, the sequence in which the first two sub-pixels in the previous row are arranged is opposite to the sequence in which the last two sub-pixels in the next row are arranged.

Specifically, as shown in FIG. 1(*c*), the first two sub-pixels in the previous row are sequentially a blue sub-pixel B and a red sub-pixel R, and the last two sub-pixels in the next row are sequentially a red sub-pixel R and a blue sub-pixel B. In this embodiment, the manner in which the sub-pixels in the pixel array are arranged is not limited hereto.

For example, in the pixel array provided by this embodiment, the first two sub-pixels in the previous row are sequentially a blue sub-pixel and a green sub-pixel, and the last two sub-pixels in the next row are sequentially a green sub-pixel and a blue sub-pixel; or the first two sub-pixels in the previous row are sequentially a red sub-pixel and a blue sub-pixel, and the last two sub-pixels in the next row are sequentially a blue sub-pixel and a red sub-pixel; or the first two sub-pixels in the previous row are sequentially a green sub-pixel and a red sub-pixel, and the last two sub-pixels in the next row are sequentially a red sub-pixel and a green sub-pixel; or the first two sub-pixels in the previous row are sequentially a red sub-pixel and a green sub-pixel, and the last two sub-pixels in the next row are sequentially a green sub-pixel and a red sub-pixel; or the first two sub-pixels in the previous row are sequentially a green sub-pixel and a blue sub-pixel, and the last two sub-pixels in the next row are sequentially a blue sub-pixel and a green sub-pixel.

Accordingly, as shown in FIG. 1(*a*), FIG. 1(*c*), FIG. 1(*d*), FIG. 1(*f*), FIG. 1(*g*) and FIG. 1(*j*), in each pixel unit, the sequence in which the last two sub-pixels in the previous row are arranged may be the same as the sequence in which the first two sub-pixels in the next row are arranged.

Or, as shown in FIG. 1(*b*), FIG. 1(*e*), FIG. 1(*h*) and FIG. 1(*i*), in each pixel unit, the sequence in which the last two sub-pixels in the previous row are arranged is opposite to the sequence in which the first two sub-pixels in the next row are arranged.

As another aspect of the present invention, there is provided a driving method of the above-mentioned pixel array provided by the present invention, and the driving method includes steps of:

S1. calculating a theoretical brightness value of an image to be displayed at each sub-pixel;

S2. calculating an actual brightness value of each sub-pixel, wherein the actual brightness value of each sub-pixel is a sum of a portion of the theoretical brightness value of the sub-pixel and portions of the theoretical brightness values of sub-pixels having the same color as the sub-pixel in the same row; and S3. inputting a signal to each sub-pixel, so as to enable each sub-pixel to achieve the actual brightness value calculated in the step of S2.

In the step of S2 of the driving method provided by the present invention, the actual brightness value output to one sub-pixel is the sum of a portion of the theoretical brightness value of the sub-pixel and portions of the theoretical brightness values of the sub-pixels having the same color as and adjacent to the sub-pixel in the same row. Namely, during display, one sub-pixel shares the brightness signals of other sub-pixels having the same color as the sub-pixel, such that the transition between the adjacent sub-pixels is smoother. When using the above-mentioned driving method to drive the pixel array, the display panel including the pixel array provided by the present invention can be less grainy, thus achieving display effect of a display panel with a higher resolution under the same size.

Figure 3:
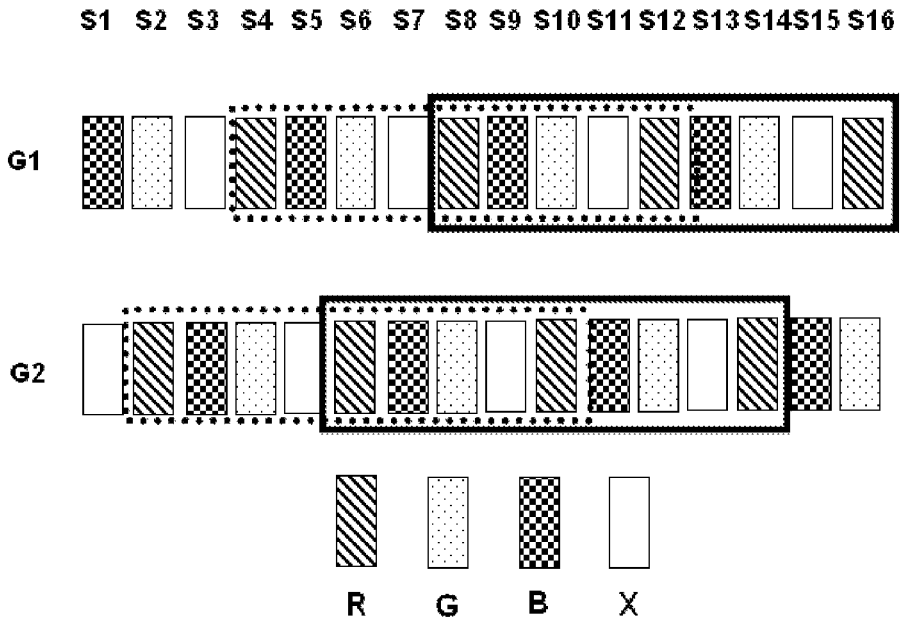
FIG. 3 is a schematic diagram of output of a red sub-pixel in a first embodiment of a driving method provided by the present invention.

In the present invention, other sub-pixels used in calculating the actual brightness value of the specified sub-pixel in the step of S2 are not particularly limited. For example, as shown in FIG. 3, the actual brightness value of the specified sub-pixel may be calculated by using two sub-pixels adjacent to the specified sub-pixel and having the same color. That is, when the actual brightness value of the sub-pixel in the G1 row and S8 column is calculated, a portion of the theoretical brightness value of the sub-pixel in the G1 row and S8 column, a portion of the theoretical brightness value of the sub-pixel in the G1 row and S4 column and a portion of the theoretical brightness value of the sub-pixel in the G1 row and S12 column may be adopted.

Specifically, it is assumed that, the pixel array includes Y columns of sub-pixels, in the step of S2, the actual brightness value A(m,n) of the sub-pixel in the $m^{th}$ row and $n^{th}$ column may be calculated by using the following formula (1):

$$A(m,n)=x[aT(m,n-4)+bT(m,n)+aT(m,n+4)] \quad (1)$$

wherein, m is a natural number;

n is a natural number, and $5 \le n \le Y-4$;

T (m, n) refers to the theoretical brightness value of the sub-pixel in the $m^{th}$ row and $n^{th}$ column;

T (m, n−4) refers to the theoretical brightness value of the sub-pixel in the $m^{th}$ row and $(n-4)^{th}$ column;

T (m, n+4) refers to the theoretical brightness value of the sub-pixel in the $m^{th}$ row and $(n+4)^{th}$ column;

$2a+b=1$ and $0<x<1$.

Figures 7, 8, 9:
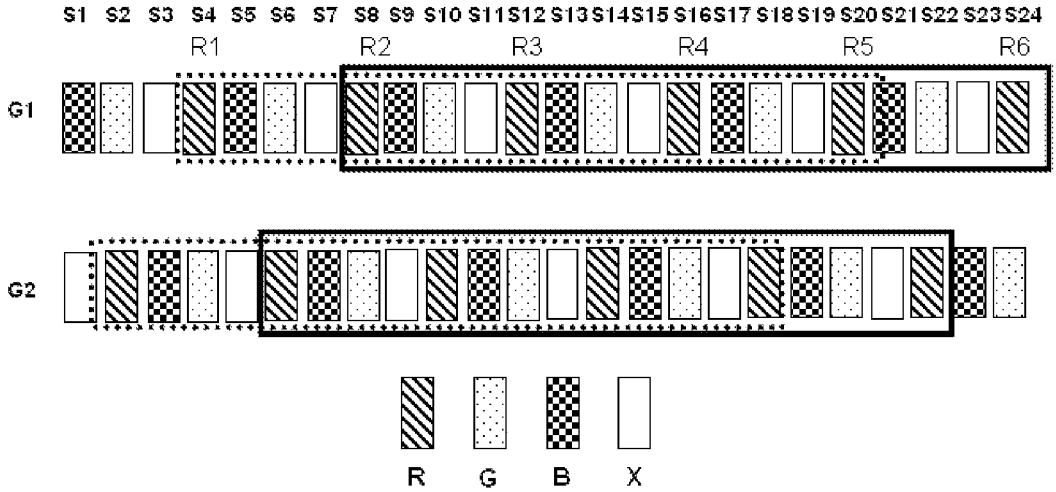
FIG. 7 is an algorithm matrix of the first embodiment of a driving method provided by the present invention, when the X sub-pixel is a white sub-pixel.
FIG. 8 is another algorithm matrix of the first embodiment of a driving method provided by the present invention, when the X sub-pixel is a white sub-pixel.
FIG. 9 is a schematic diagram of output of a red sub-pixel in a second embodiment of a driving method provided by the present invention.

For example, when the theoretical brightness value A(1, 8)=x[aT(1,4)+bT(1,8)+aT(1,12)] of the sub-pixel in the G1 row and S8 column is calculated, FIG. 7 and FIG. 8 show the values of correction coefficient x, a and b when calculating each sub-pixel. In the figures, a fractional value outside brackets is a value of x, and values in brackets are sequentially values of a, b and a.

The brightness value of the sub-pixel in the G1 row and S8 column in FIG. 3 may be calculated according to the embodiment in FIG. 7(*a*), namely, a=0.1, b=0.8, x=¾, that is, A(1,8)=¾[0.1T(1,4)+0.8T(1,8)+0.1T(1,12)]. It can be known that, when the brightness value of the sub-pixel in the G1 row and S8 column is calculated, in addition to the theoretical brightness value of the sub-pixel in the G1 row and S8 column, the theoretical brightness values of the sub-pixel in the G1 row and S4 column and the sub-pixel in the G1 row and S12 column are further required. Similarly, when the brightness value of the sub-pixel in the G2 row and S8 column is calculated, in addition to the theoretical brightness value of the sub-pixel in the G2 row and S8 column, the theoretical brightness values of the sub-pixel in the G2 row and S4 column and the sub-pixel in the G2 row and S12 column are further required.

Figure 4:
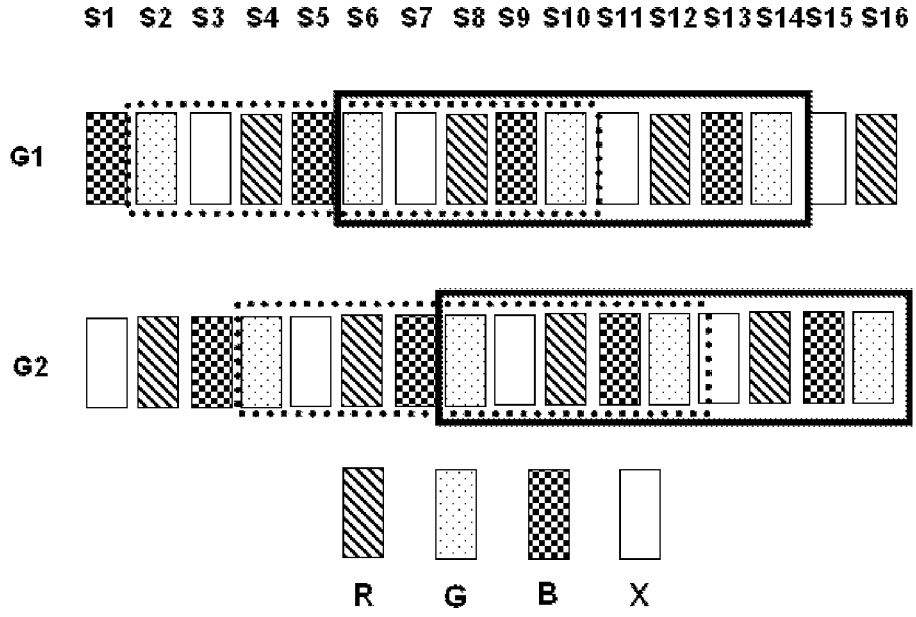
FIG. 4 is a schematic diagram of output of a green sub-pixel in the first embodiment of a driving method provided by the present invention.

If the actual brightness value of the sub-pixel in the G1 row and S6 column in FIG. 4 is calculated according to the embodiment in FIG. 7(*a*), when the brightness value of the sub-pixel in the G1 row and S6 column is calculated, in addition to the theoretical brightness value of the sub-pixel in the G1 row and S6 column, the theoretical brightness values of the sub-pixel in the G1 row and S2 column and the sub-pixel in the G1 row and S10 column are further required. Similarly, when the brightness value of the sub-pixel in the G2 row and S6 column is calculated, in addition to the theoretical brightness value of the sub-pixel in the G2 row and S6 column, the theoretical brightness values of the sub-pixel in the G2 row and S2 column and the sub-pixel in the G2 row and S10 column are further required.

Figure 5:
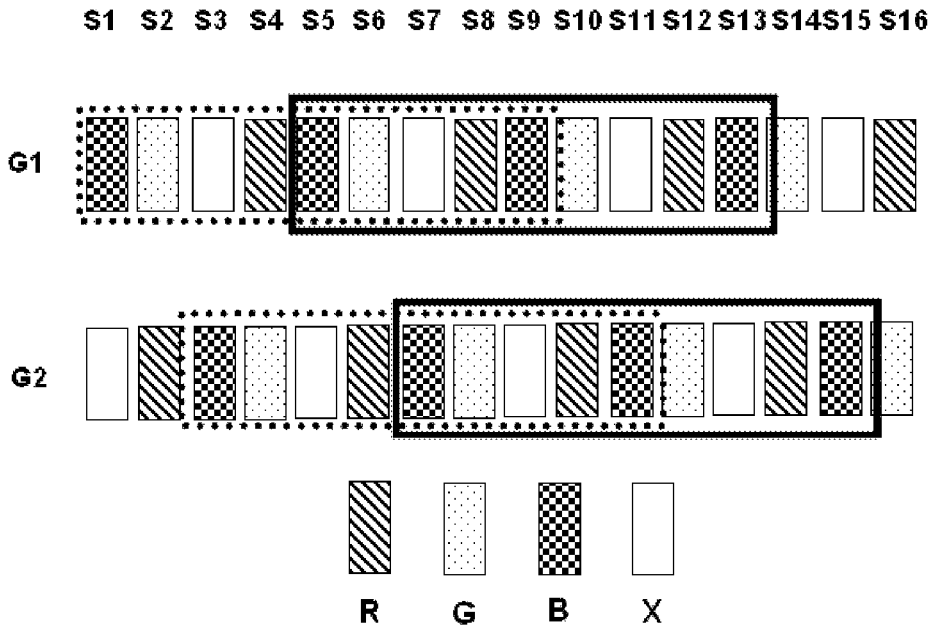
FIG. 5 is a schematic diagram of output of a blue sub-pixel in the first embodiment of a driving method provided by the present invention.

If the actual brightness value of the sub-pixel in the G1 row and S5 column in FIG. 5 is calculated according to the embodiment in FIG. 7(*a*), when the brightness value of the sub-pixel in the G1 row and S5 column is calculated, in addition to the theoretical brightness value of the sub-pixel in the G1 row and S5 column, the theoretical brightness values of the sub-pixel in the G1 row and S1 column and the sub-pixel in the G1 row and S9 column are further required. Similarly, when the brightness value of the sub-pixel in the G2 row and S5 column is calculated, in addition to the theoretical brightness value of the sub-pixel in the G2 row and S5 column, the theoretical brightness values of the sub-pixel in the G2 row and S1 column and the sub-pixel in the G2 row and S9 column are further required.

Figure 6:
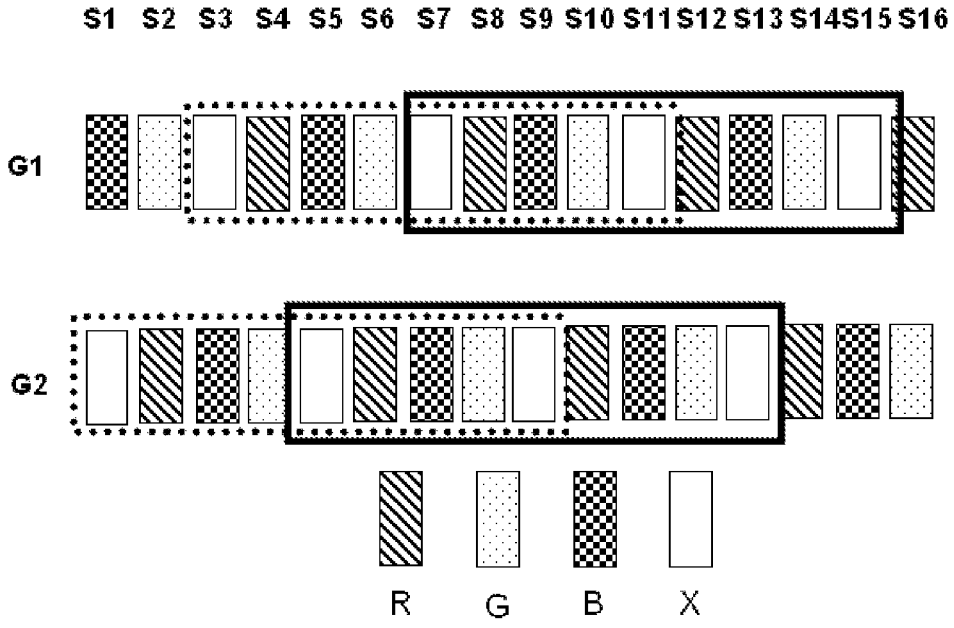
FIG. 6 is a schematic diagram of output of an X sub-pixel in the first embodiment of a driving method provided by the present invention.

If the actual brightness value of the sub-pixel in the G1 row and S7 column in FIG. 6 is calculated according to the embodiment in FIG. 7(*a*), when the brightness value of the sub-pixel in the G1 row and S7 column is calculated, in addition to the theoretical brightness value of the sub-pixel in the G1 row and S7 column, the theoretical brightness values of the sub-pixel in the G1 row and S3 column and the sub-pixel in the G1 row and S11 column are further required. Similarly, when the brightness value of the sub-pixel in the G2 row and S7 column is calculated, in addition to the theoretical brightness value of the sub-pixel in the G2 row and S7 column, the theoretical brightness values of the sub-pixel in the G2 row and S3 column and the sub-pixel in the G2 row and S11 column are further required.

Similarly, the brightness value of the sub-pixel in the G1 row and S8 column in FIG. 3 may also be calculated according to the embodiment in FIG. 7(*b*), namely, a=0.1, b=0.8, x=¾, that is, a=0.15, c=0.7, x=¾, that is, A(1,8)=¾[0.15T(1,4)+0.7T(1,8)+0.15T(1,12)]. FIG. 7(*c*) to FIG. 7(*h*) further show other optional values of a and b.

The difference between the embodiment shown in FIG. 8 and the embodiment shown in FIG. 7 lies in that, the correction coefficient is selected from ¾ and ¼ in FIG. 7, while the correction coefficient x is selected from ⅘ and ⅕ in FIG. 8. Of course, in addition to the embodiments listed in FIG. 7 and FIG. 8, other embodiments may also be selected according to a design demand.

The brightness of a sub-pixel located after the $5^{th}$ column and before or in the $(Y-4)^{th}$ column can be calculated by using the formula (1), the brightness A (m, n) of a sub-pixel in the first four columns may be calculated by using the following formula (2):

$$A(m,n)=x[cT(m,n)+dT(m,n+4)] \quad (2)$$

wherein, m is a natural number;

n is a natural number smaller than 5;

T (m, n) refers to the theoretical brightness value of the sub-pixel in the $m^{th}$ row and $n^{th}$ column;

T (m, n+4) refers to the theoretical brightness value of the sub-pixel in the $m^{th}$ row and $(n+4)^{th}$ column;

c+d=1;

0<x<1.

The above-mentioned formula is used for calculating the brightness of a sub-pixel at an edge. For example, when the actual brightness value of the sub-pixel in the G1 row and S1 column is calculated, A(1,1)=¾[0.8T(1,1)+0.2T(1,5)].

The actual brightness values of a sub-pixel in the last four columns may be calculated by using the following formula (3):

$$A(m,n)=x[ET(m,n-4)+FT(m,n)] \quad (3)$$

wherein, m is a natural number;

n is a natural number, and Y−4<n≤Y;

T (m, n) refers to the theoretical brightness value of the sub-pixel in the $m^{th}$ row and $n^{th}$ column;

T (m, n−4) refers to the theoretical brightness value of the sub-pixel in the $m^{th}$ row and $(n-4)^{th}$ column;

E+F=1, 0<x<1.

As mentioned above, in the present invention, the specific color of the X sub-pixel is not limited, for example, the X sub-pixel may be a yellow sub-pixel, or may also be a cyan sub-pixel or a white sub-pixel. When the X sub-pixel is a white sub-pixel, since the transmittance of the white sub-pixel is very high, compared to calculating the sub pixels of other colors, when the actual brightness of the white sub-pixel is calculated, the correction coefficient may be smaller. For example, in the embodiment shown in FIG. 7, when the actual brightness of the sub-pixel of a color other than white is calculated, the correction coefficient x1 is ¾, and when the actual brightness of the white sub-pixel is calculated, the correction coefficient x2 is ¼; in the embodiment shown in FIG. 8, when the actual brightness of the sub-pixel of a color other than white is calculated, the correction coefficient x1 is ⅘, and when the actual brightness of the white sub-pixel is calculated, the correction coefficient x2 is ⅕. The common point of the embodiment shown in FIG. 7 and the embodiment shown in FIG. 8 is that, x1+x2=1, and x2≤0.25.

FIG. 9 to FIG. 13 show another embodiment of calculating the actual brightness values of the sub-pixels.

Specifically, it is assumed that the pixel array includes Y columns of sub-pixels, the actual brightness value A (m, n) of the sub-pixel in the $m^{th}$ row and $n^{th}$ column may be calculated by using the following formula (3) in the step of S2:

$$A(m,n)=x[eT(m,n-8)+fT(m,n-4)+gT(m,n)+fT(m,n+4)+eT(m,n+8)] \quad (4)$$

wherein, m is a natural number;

n is a natural number, and 9≤n≤Y−8;

T (m, n) refers to the theoretical brightness value of the sub-pixel in the $m^{th}$ row and $n^{th}$ column;

T (m, n−8) refers to the theoretical brightness value of the sub-pixel in the $m^{th}$ row and $(n-8)^{th}$ column;

T (m, n−4) refers to the theoretical brightness value of the sub-pixel in the $m^{th}$ row and $(n-4)^{th}$ column;

T (m, n+4) refers to the theoretical brightness value of the sub-pixel in the $m^{th}$ row and $(n+4)^{th}$ column;

T (m, n+8) refers to the theoretical brightness value of the sub-pixel in the $m^{th}$ row and $(n+8)^{th}$ column;

2e+2f+g=1;

0<x<1.

For example, when the theoretical brightness value A(1, 12) of the sub-pixel in the G1 row and S12 column is calculated, A(1,12)=x[eT(1,4)+fT(1,8)+gT(1,12)+eT(1, 16)+fT(1,20)]. FIG. 13 shows the values of the correction coefficient x, e, f and g, when the sub-pixels are calculated. In the figures, a fractional value outside brackets is a value of x, and values in brackets are sequentially values of e, f, g, f and e.

The brightness value of the sub-pixel in the G1 row and S12 column in FIG. 9 may be calculated according to the embodiment in FIG. 13(*a*), namely, e=0.02, f=0.08, g=0.8, x=¾, that is, A(1,12)=¾[0.02T(1,4)+0.08T(1,8)+0.8T(1, 12)+0.02T(1,16)+0.08T(1,20)]. Therefore, when the brightness value of the sub-pixel in the G1 row and S12 column is calculated, in addition to the theoretical brightness value of the sub-pixel in the G1 row and S12 column, the theoretical brightness values of the sub-pixel in the G1 row and S4 column, the sub-pixel in the G1 row and S8 column, the sub-pixel in the G1 row and S16 column and the sub-pixel in the G1 row and S20 column are further required. Similarly, when the brightness value of the sub-pixel in the G2 row and S12 column is calculated, in addition to the theoretical brightness value of the sub-pixel in the G2 row and S12 column, the theoretical brightness values of the sub-pixel in the G2 row and S4 column, the sub-pixel in the G2 row and S8 column, the sub-pixel in the G2 row and S16 column and the sub-pixel in the G2 row and S20 column are further required.

Figure 10:
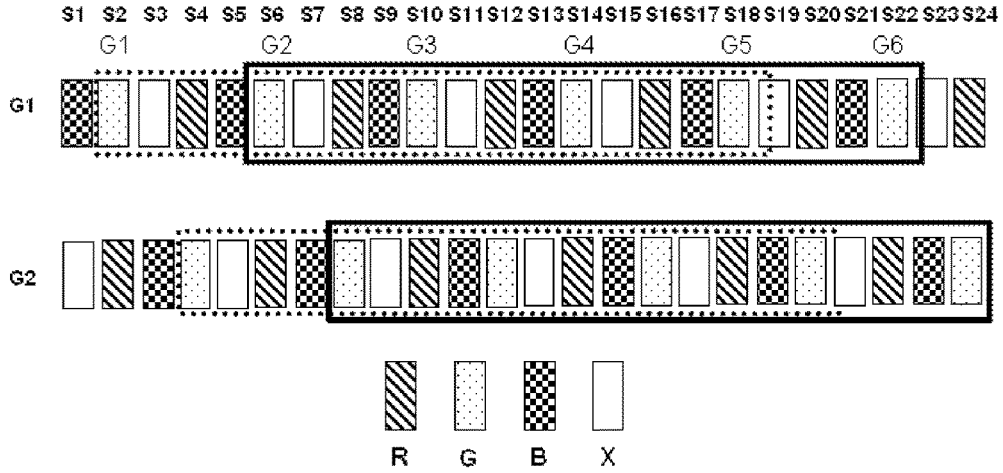
FIG. 10 is a schematic diagram of output of a green sub-pixel in the second embodiment of a driving method provided by the present invention.

If the actual brightness value of the sub-pixel in the G1 row and S10 column in FIG. 10 is calculated according to the embodiment in FIG. 13(*a*), when the brightness value of the sub-pixel in the G1 row and S10 column is calculated, in addition to the theoretical brightness value of the sub-pixel in the G1 row and S10 column, the theoretical brightness values of the sub-pixel in the G1 row and S2 column, the sub-pixel in the G1 row and S6 column, the sub-pixel in the G1 row and S14 column and the sub-pixel in the G1 row and S18 column are further required. Similarly, when the brightness value of the sub-pixel in the G2 row and S10 column is calculated, in addition to the theoretical brightness value of the sub-pixel in the G2 row and S10 column, the theoretical brightness values of the sub-pixel in the G2 row and S2 column, the sub-pixel in the G2 row and S6 column, the sub-pixel in the G2 row and S14 column and the sub-pixel in the G2 row and S18 column are further required.

Figure 11:
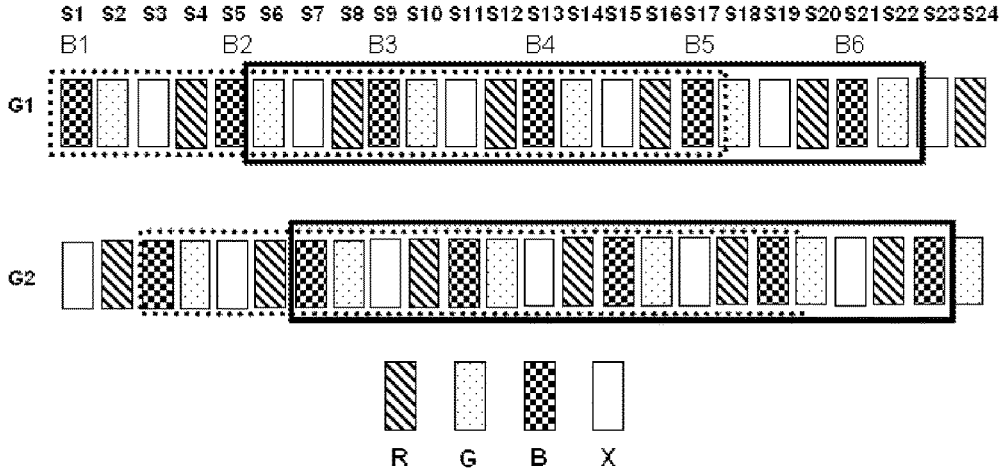
FIG. 11 is a schematic diagram of output of a blue sub-pixel in the second embodiment of a driving method provided by the present invention.

If the actual brightness value of the sub-pixel in the G1 row and S9 column in FIG. 11 is calculated according to the embodiment in FIG. 13(*a*), when the brightness value of the sub-pixel in the G1 row and S9 column is calculated, in addition to the theoretical brightness value of the sub-pixel in the G1 row and S9 column, the theoretical brightness values of the sub-pixel in the G1 row and S1 column, the sub-pixel in the G1 row and S5 column, the sub-pixel in the G1 row and S13 column and the sub-pixel in the G1 row and S17 column are further required. Similarly, when the brightness value of the sub-pixel in the G2 row and S9 column is calculated, in addition to the theoretical brightness value of the sub-pixel in the G2 row and S9 column, the theoretical brightness values of the sub-pixel in the G2 row and S1 column, the sub-pixel in the G2 row and S5, the sub-pixel in the G2 row and S13 column and the sub-pixel in the G2 row and S17 column are further required.

Figure 12:
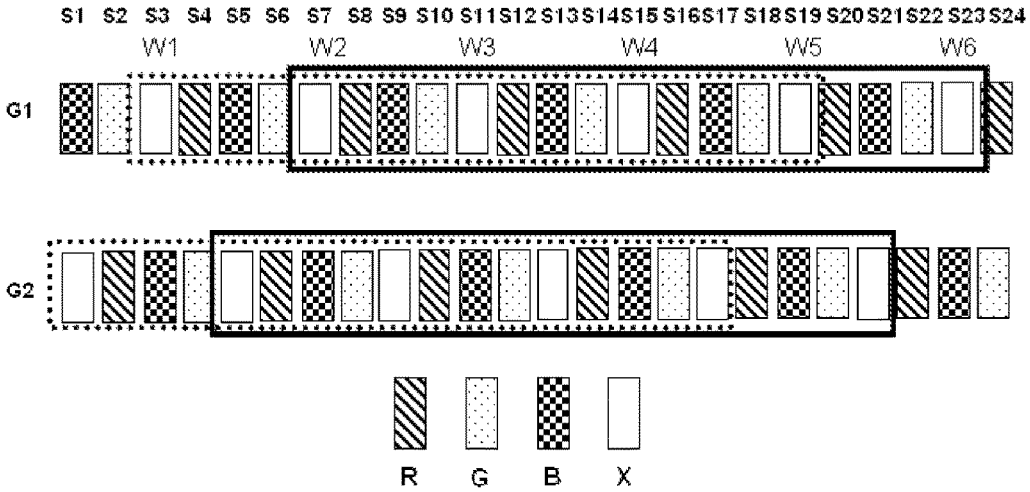
FIG. 12 is a schematic diagram of output of an X sub-pixel in the second embodiment of a driving method provided by the present invention.

If the actual brightness value of the sub-pixel in the G1 row and S11 column in FIG. 12 is calculated according to the embodiment in FIG. 13(*a*), when the brightness value of the sub-pixel in the G1 row and S11 column is calculated, in addition to the theoretical brightness value of the sub-pixel in the G1 row and S11 column, the theoretical brightness values of the sub-pixel in the G1 row and S3 column, the sub-pixel in the G1 row and S7 column, the sub-pixel in the G1 row and S15 column and the sub-pixel in the G1 row and S19 column are further required. Similarly, when the brightness value of the sub-pixel in the G2 row and S11 column is calculated, in addition to the theoretical brightness value of the sub-pixel in the G2 row and S11 column, the theoretical brightness values of the sub-pixel in the G2 row and S3 column, the sub-pixel in the G2 row and S7 column, the sub-pixel in the G2 row and S15 column and the sub-pixel in the G2 row and S19 column are further required.

Similarly, the brightness value of the sub-pixel in the G1 row and S12 column in FIG. 9 may also be calculated according to the embodiment in FIG. 13(*b*), namely, e=0.05, f=0.1, g=0.7, x=¾, that is, A(1,12)=¾[0.05T(1,4)+0.1T(1,8)+0.7T(1,12)+0.1T(1,16)+0.05T(1,20)]. FIG. 13(*c*) to FIG. 13(*h*) further show other optional values of e, f and g.

The brightness of a sub-pixel located after the $8^{th}$ column may be calculated by using the formula (3), and the brightness A (m, n) of a sub-pixel located in the first four columns may be calculated by using the following formula (5):

$$A(m,n)=x[hT(m,n)+iT(m,n+4)+jT(m,n+8)] \quad (5)$$

wherein, m is a natural number;

n is a natural number not larger than 4;

T (m, n) refers to the theoretical brightness value of the sub-pixel in the $m^{th}$ row and $n^{th}$ column;

T (m, n+4) refers to the theoretical brightness value of the sub-pixel in the $m^{th}$ row and $(n+4)^{th}$ column;

T (m, n+8) refers to the theoretical brightness value of the sub-pixel in the $m^{th}$ row and $(n+8)^{th}$ column h+i+j=1;

0<x<1.

The above-mentioned formula (5) is used for calculating the brightness of a sub-pixel at an edge. For example, when the actual brightness value of the sub-pixel in the G1 row and S1 column is calculated, A(1,1)=¾[0.8T(1,1)+0.1T(1,5)+0.1T(1,9)].

Accordingly, the actual brightness value of a sub-pixel located from the $5^{th}$ to the $8^{th}$ columns may be calculated by using the following formula (6):

$$A(m,n)=x[lT(m,n-4)+kT(m,n)+lT(m,n+4)+MT(m,n+8)] \quad (6)$$

wherein, m is a natural number;

n is a natural number, and 4<n≤8;

T (m, n−4) refers to the theoretical brightness value of the sub-pixel in the $m^{th}$ row and $(n-4)^{th}$ column;

T (m, n) refers to the theoretical brightness value of the sub-pixel in the $m^{th}$ row and $n^{th}$ column;

T (m, n+4) refers to the theoretical brightness value of the sub-pixel in the $m^{th}$ row and $(n+4)^{th}$ column;

T (m, n+8) refers to the theoretical brightness value of the sub-pixel in the $m^{th}$ row and $(n+8)^{th}$ column;

2l+M+k=1;

0<x<1.

Accordingly, the actual brightness value of a sub-pixel located from the $(Y-7)^{th}$ to the $(Y-4)^{th}$ columns may be calculated by using the following formula (7):

$$A(m,n)=x[MT(m,n-8)+NT(m,n-4)+oT(m,n)+NT(m,n+4)] \quad (7)$$

wherein, m is a natural number;

n is a natural number, and Y−8<n≤Y−4;

T (m, n−8) refers to the theoretical brightness value of the sub-pixel in the $m^{th}$ row and $(n-8)^{th}$ column;

T (m, n−4) refers to the theoretical brightness value of the sub-pixel in the $m^{th}$ row and $(n-4)^{th}$ column;

T (m, n) refers to the theoretical brightness value of the sub-pixel in the $m^{th}$ row and $n^{th}$ column;

T (m, n+4) refers to the theoretical brightness value of the sub-pixel in the $m^{th}$ row and $(n+4)^{th}$ column;

M+2N+o=1;

0<x<1.

Accordingly, the actual brightness value of a sub-pixel located from the $(Y-3)^{th}$ to the $Y^{th}$ columns may be calculated by using the following formula (8):

$$A(m,n)=x[pT(m,n-8)+qT(m,n-4)+rT(m,n)] \quad (8)$$

wherein, m is a natural number;

n is a natural number, and Y−4<n≤Y;

T (m, n−8) refers to the theoretical brightness value of the sub-pixel in the $m^{th}$ row and $(n-8)^{th}$ column;

T (m, n−4) refers to the theoretical brightness value of the sub-pixel in the $m^{th}$ row and $(n-4)^{th}$ column;

T (m, n) refers to the theoretical brightness value of the sub-pixel in the $m^{th}$ row and $n^{th}$ column;

p+q+r=1;

0<x<1.

Similar to the embodiment shown in FIG. 7, in the embodiment shown in FIG. 13, when the actual brightness of the sub-pixel of a color other than white is calculated, the correction coefficient x1 is ¾, and when the actual brightness of the white sub-pixel is calculated, the correction coefficient x2 is ¼. Of course, the correction coefficient x1 may also be ⅘, and when the actual brightness of the white sub-pixel is calculated, the correction coefficient x2 may also be ⅕. In the embodiments shown in FIG. 9 to FIG. 13, the correction coefficient x still meets the following relationships: $x1+x2=1$, and $x2\leq 0.25$.

Of course, in addition to the embodiments shown in FIG. 7, FIG. 8 and FIG. 13, the parameters in the formula may also be other values according to design demands.

As another aspect of the present invention, there is further provided a display panel including a pixel array, wherein the pixel array is the above-mentioned pixel array provided by the present invention.

As another aspect of the present invention, there is further provided a display device including a display panel, wherein the display panel is the above-mentioned display panel provided by the present invention.

The display device may be a mobile phone, a computer or the like. The display device not only has a simple manufacturing process, but also can achieve display effect of a display device with a higher resolution under the same size.

Compared with the prior art, each sub-pixel in the pixel array provided by the present invention has a larger width, thereby reducing the general processing difficulty of the display panel and improving the aperture ratio of the display panel. Moreover, by using the driving method provided by the present invention to drive the pixel array, the display panel can be less grainy, thus achieving display effect of a display panel with a higher resolution under the same size.

It can be understood that, the foregoing embodiments are merely exemplary embodiments used for illustrating the principle of the present invention, but the present invention is not limited hereto. Those of ordinary skill in the art may make various variations and improvements without departing from the spirit and essence of the present invention, and these variations and improvements are also deemed as falling within the protection scope of the present invention.

The invention claimed is:

1. A pixel array, comprising a plurality of pixel units, each of which comprises two rows of sub-pixels, each row of sub-pixels comprising four sub-pixels of different colors, wherein, in each pixel unit, colors of the first two sub-pixels in the previous row are the same as those of the last two sub-pixels in the next row, colors of the last two sub-pixels in the previous row are the same as those of the first two sub-pixels in the next row, and in the same row, any two adjacent sub-pixels form one pixel block, wherein in each pixel unit, a sequence in which the first two sub-pixels in the previous row are arranged is opposite to a sequence in which the last two sub-pixels in the next row are arranged, and wherein in each pixel unit, a sequence in which the last two sub-pixels in the previous row are arranged is the same as a sequence in which the first two sub-pixels in the next row are arranged.

2. The pixel array of claim 1, wherein in each pixel unit:

the first two sub-pixels in the previous row are sequentially a blue sub-pixel and a red sub-pixel, and the last two sub-pixels in the next row are sequentially a red sub-pixel and a blue sub-pixel; or the first two sub-pixels in the previous row are sequentially a blue sub-pixel and a green sub-pixel, and the last two sub-pixels in the next row are sequentially a green sub-pixel and a blue sub-pixel; or the first two sub-pixels in the previous row are sequentially a red sub-pixel and a blue sub-pixel, and the last two sub-pixels in the next row are sequentially a blue sub-pixel and a red sub-pixel; or the first two sub-pixels in the previous row are sequentially a green sub-pixel and a red sub-pixel, and the last two sub-pixels in the next row are sequentially a red sub-pixel and a green sub-pixel; or the first two sub-pixels in the previous row are sequentially a red sub-pixel and a green sub-pixel, and the last two sub-pixels in the next row are sequentially a green sub-pixel and a red sub-pixel; or the first two sub-pixels in the previous row are sequentially a green sub-pixel and a blue sub-pixel, and the last two sub-pixels in the next row are sequentially a blue sub-pixel and a green sub-pixel.

3. A driving method of a pixel array, wherein the pixel array is the pixel array of claim 1, and the driving method comprises steps of:

S1. calculating a theoretical brightness value of an image to be displayed at each sub-pixel;

S2. calculating an actual brightness value of each sub-pixel, wherein the actual brightness value of each sub-pixel is a sum of a portion of the theoretical brightness value of the sub-pixel and a portion or portions of the theoretical brightness value of one or more sub-pixels having the same color as the sub-pixel in the same row; and S3. inputting a signal to each sub-pixel, so as to enable each sub-pixel to achieve the actual brightness value calculated in the step of S2.

4. The driving method of claim 3, wherein the pixel array comprises Y columns of sub-pixels, A (m, n) refers to the actual brightness value of the sub-pixel in the $m^{th}$ row and $n^{th}$ column, T (m, n) refers to the theoretical brightness value of the sub-pixel in the $m^{th}$ row and $n^{th}$ column, T (m, n−4) refers to the theoretical brightness value of the sub-pixel in the $m^{th}$ row and $(n-4)^{th}$ column, T (m, n+4) refers to the theoretical brightness value of the sub-pixel in the $m^{th}$ row and $(n+4)^{th}$ column, and in the step of S2, calculating the actual brightness value of each sub-pixel by using a formula $A(m,n)=x[aT(m,n-4)+bT(m,n)+aT(m,n+4)]$, wherein m is a natural number, n is a natural number, $5\leq n\leq Y-4$, $2a+b=1$, and $0<x<1$;

or, calculating the actual brightness value of each sub-pixel by using a formula $A(m,n)=x[cT(m,n)+dT(m,n+4)]$, wherein m is a natural number, n is a natural number smaller than 5, $c+d=1$, and $0<x<1$;

or, calculating the actual brightness value of each sub-pixel by using a formula $A(m,n)=x[ET(m,n-4)+FT(m,n)]$, wherein m is a natural number, n is a natural number, $Y-4<n\leq Y$, $E+F=1$, and $0<x<1$.

5. The driving method of claim 4, wherein the four sub-pixels of different colors comprise a red sub-pixel, a green sub-pixel, a blue sub-pixel and an X sub-pixel, the X sub-pixel is a white sub-pixel, when the sub-pixel in the $m^{th}$ row and $n^{th}$ column is not the white sub-pixel, x is x1, when the sub-pixel in the $m^{th}$ row and $n^{th}$ column is the white sub-pixel, x is x2, wherein $x2\leq 0.25$, and $x1+x2=1$.

6. The driving method of claim 5, wherein x1 is ¾ or ⅘.

7. The driving method of claim 3, wherein the pixel array comprises Y columns of sub-pixels, A (m, n) refers to the actual brightness value of the sub-pixel in the $m^{th}$ row and $n^{th}$ column, T (m, n) refers to the theoretical brightness value of the sub-pixel in the $m^{th}$ row and $n^{th}$ column, T (m, n−8) refers to the theoretical brightness value of the sub-pixel in the $m^{th}$ row and $(n-8)^{th}$ column, T (m, n−4) refers to the theoretical brightness value of the sub-pixel in the $m^{th}$ row and $(n-4)^{th}$ column, T (m, n+4) refers to the theoretical brightness value of the sub-pixel in the $m^{th}$ row and $(n+4)^{th}$ column, T (m, n+8) refers to the theoretical brightness value of the sub-pixel in the $m^{th}$ row and $(n+8)^{th}$ column, and in the step of S2, calculating the actual brightness value of each sub-pixels by using a formula $A(m,n)=x[eT(m,n-8)+ff(m,n-4)+gT(m,n)+fT(m,n+4)+eT(m,n+8)]$, wherein m is a natural number, n is a natural number, $9\leq n\leq Y-8$, $2e+2f+g=1$, and $0<x<1$;

or, calculating the actual brightness value of each sub-pixel by using a formula $A(m,n)=x[hT(m,n)+iT(m,n+4)+jT(m,n+8)]$, wherein m is a natural number, n is a natural number not larger than 4, $h+i+j=1$, and $0<x<1$;

or, calculating the actual brightness value of each sub-pixel by using a formula $A(m,n)=x[lT(m,n-4)+kT(m,n)+lT(m,n+4)+MT(m,n+8)]$, wherein m is a natural number, n is a natural number, $4<n\leq 8$, $2l+M+k=1$, and $0<x<1$;

or, calculating the actual brightness value of each sub-pixel by using a formula $A(m,n)=x[MT(m,n-8)+NT(m,n-4)+oT(m,n)+NT(m,n+4)]$, wherein m is a natural number, n is a natural number, $Y-8\leq n\leq Y-4$, $M+2N+o=1$, and $0<x<1$;

or, calculating the actual brightness value of each sub-pixel by using a formula $A(m,n)=x[pT(m,n-8)+qT(m,n-4)+rT(m,n)]$, wherein m is a natural number, n is a natural number, $Y-4<n\leq Y$, $p+q+r=1$, and $0<x<1$.

8. The driving method of claim 7, wherein the four sub-pixels of different colors comprise a red sub-pixel, a green sub-pixel, a blue sub-pixel and an X sub-pixel, the X sub-pixel is a white sub-pixel, when the sub-pixel in the $m^{th}$ row and $n^{th}$ column is not the white sub-pixel, x is x1, when the sub-pixel in the $m^{th}$ row and $n^{th}$ column is the white sub-pixel, x is x2, wherein $x2\leq 0.25$, and $x1+x2=1$.

9. A display device, comprising a display panel, wherein the display panel comprises the pixel array of claim 1.

10. A pixel array, comprising a plurality of pixel units, each of which comprises two rows of sub-pixels, each row of sub-pixels comprising four sub-pixels of different colors wherein, in each pixel unit, colors of the first two sub-pixels in the previous row are the same as those of the last two sub-pixels in the next row, colors of the last two sub-pixels in the previous row are the same as those of the first two sub-pixels in the next row, and in the same row, any two adjacent sub-pixels form one pixel block, wherein in each pixel unit, a sequence in which the first two sub-pixels in the previous row are arranged is the same as a sequence in which the last two sub-pixels in the next row are arranged, and wherein in each pixel unit, a sequence in which the last two sub-pixels in the previous row are arranged is opposite to a sequence in which the first two sub-pixels in the next roe are arranged.

11. The pixel array of claim 10, wherein in each pixel unit: the first two sub-pixels in the previous row are sequentially a blue sub-pixel and a green sub-pixel, and the last two sub-pixels in the next row are sequentially a blue sub-pixel and a green sub-pixel; or the first two sub-pixels in the previous row are sequentially a blue sub-pixel and a red sub-pixel, and the last two sub-pixels in the next row are sequentially a blue sub-pixel and a red sub-pixel; or the first two sub-pixels in the previous row are sequentially a red sub-pixel and a blue sub-pixel, and the last two sub-pixels in the next row are sequentially a red sub-pixel and a blue sub-pixel; or the first two sub-pixels in the previous row are sequentially a green sub-pixel and a red sub-pixel, and the last two sub-pixels in the next row are sequentially a green sub-pixel and a red sub-pixel; or the first two sub-pixels in the previous row are sequentially a red sub-pixel and a green sub-pixel, and the last two sub-pixels in the next row are sequentially a red sub-pixel and a green sub-pixel; or the first two sub-pixels in the previous row are sequentially a green sub-pixel and a blue sub-pixel, and the last two sub-pixels in the next row are sequentially a green sub-pixel and a blue sub-pixel.

12. A display device, comprising a display panel, wherein the display panel comprises the pixel array of claim 10.

13. A driving method of a pixel array, wherein the pixel array is the pixel array of claim 10, and the driving method comprises steps of:

S1. calculating a theoretical brightness value of an image to be displayed at each sub-pixel;

S2. calculating an actual brightness value of each sub-pixel, wherein the actual brightness value of each sub-pixel is a sum of a portion of the theoretical brightness value of the sub-pixel and a portion or portions of the theoretical brightness value of one or more sub-pixels having the same color as the sub-pixel in the same row; and S3. inputting a signal to each sub-pixel, so as to enable each sub-pixel to achieve the actual brightness value calculated in the step of S2.

14. The driving method of claim 13, wherein the pixel array comprises Y columns of sub-pixels, A (m, n) refers to the actual brightness value of the sub-pixel in the $m^{th}$ row and $n^{th}$ column, T (m, n) refers to the theoretical brightness value of the sub-pixel in the $m^{th}$ row and $n^{th}$ column, T (m, n−4) refers to the theoretical brightness value of the sub-pixel in the $m^{th}$ row and $(n-4)^{th}$ column, T (m, n+4) refers to the theoretical brightness value of the sub-pixel in the $m^{th}$ row and $(n+4)^{th}$ column, and in the step of S2, calculating the actual brightness value of each sub-pixel by using a formula $A(m,n)=x[aT(m,n-4)+bT(m,n)+aT(m,n+4)]$, wherein m is a natural number, n is a natural number, $5\leq n\leq Y-4$, $2a+b=1$, and $0<x<1$;

or, calculating the actual brightness value of each sub-pixel by using a formula $A(m,n)=x[cT(m,n)+dT(m,n+4)]$, wherein m is a natural number, n is a natural number smaller than 5, $c+d=1$, and $0<x<1$;

or, calculating the actual brightness value of each sub-pixel by using a formula $A(m,n)=x[ET(m,n-4)+FT(m,n)]$, wherein m is a natural number, n is a natural number, $Y-4<n\leq Y$, $E+F=1$, and $0<x<1$.

15. The driving method of claim 14, wherein the four sub-pixels of different colors comprise a red sub-pixel, a green sub-pixel, a blue sub-pixel and an X sub-pixel, the X sub-pixel is a white sub-pixel, when the sub-pixel in the $m^{th}$ row and $n^{th}$ column is not the white sub-pixel, x is x1, when the sub-pixel in the $m^{th}$ row and $n^{th}$ column is the white sub-pixel, x is x2, wherein $x2\leq 0.25$, and $x1+x2=1$.

16. The driving method of claim 15, wherein x1 is ¾ or ⅘.

17. The driving method of claim 13, wherein the pixel array comprises Y columns of sub-pixels, A (m, n) refers to the actual brightness value of the sub-pixel in the $m^{th}$ row and $n^{th}$ column, T (m, n) refers to the theoretical brightness value of the sub-pixel in the $m^{th}$ row and $n^{th}$ column, T (m, n−8) refers to the theoretical brightness value of the sub-pixel in the $m^{th}$ row and $(n-8)^{th}$ column, T (m, n−4) refers to the theoretical brightness value of the sub-pixel in the $m^{th}$ row and $(n-4)^{th}$ column, T (m, n+4) refers to the theoretical brightness value of the sub-pixel in the $m^{th}$ row and $(n+4)^{th}$ column, T (m, n+8) refers to the theoretical brightness value of the sub-pixel in the $m^{th}$ row and $(n+8)^{th}$ column, and in the step of S2, calculating the actual brightness value of each sub-pixels by using a formula $A(m,n)=x[eT(m,n-8)+ff(m,n-4)+$ $gT(m,n)+fT(m,n+4)+eT(m,n+8)]$, wherein m is a natural number, n is a natural number, $9 \leq n \leq Y-8$, $2e+2f+g=1$, and $0<x<1$;

or, calculating the actual brightness value of each sub-pixel by using a formula $A(m,n)=x[hT(m,n)+iT(m,n+4)+jT(m,n+8)]$, wherein m is a natural number, n is a natural number not larger than 4, $h+i+j=1$, and $0<x<1$;

or, calculating the actual brightness value of each sub-pixel by using a formula $A(m,n)=x[lT(m,n-4)+kT(m,n)+lT(m,n+4)+MT(m,n+8)]$, wherein m is a natural number, n is a natural number, $4<n \leq 8$, $2l+M+k=1$, and $0<x<1$;

or, calculating the actual brightness value of each sub-pixel by using a formula $A(m,n)=x[MT(m,n-8)+NT(m,n-4)+oT(m,n)+NT(m,n+4)]$, wherein m is a natural number, n is a natural number, $Y-8<n \leq Y-4$, $M+2N+o=1$, and $0<x<1$;

or, calculating the actual brightness value of each sub-pixel by using a formula $A(m,n)=x[pT(m,n-8)+qT(m,n-4)+rT(m,n)]$, wherein m is a natural number, n is a natural number, $Y-4<n \leq Y$, $p+q+r=1$, and $0<x<1$.

18. The driving method of claim 17, wherein the four sub-pixels of different colors comprise a red sub-pixel, a green sub-pixel, a blue sub-pixel and an X sub-pixel, the X sub-pixel is a white sub-pixel, when the sub-pixel in the $m^{th}$ row and $n^{th}$ column is not the white sub-pixel, x is x1, when the sub-pixel in the $m^{th}$ row and $n^{th}$ column is the white sub-pixel, x is x2, wherein $x2 \leq 0.25$, and $x1+x2=1$.

* * * * *